US007069938B2

(12) United States Patent
Yen et al.

(10) Patent No.: US 7,069,938 B2
(45) Date of Patent: Jul. 4, 2006

(54) GOLF SUNSHADE

(75) Inventors: Chiu-Chan Yen, Taipei (TW); Fu-Yi Chou, Taipei (TW)

(73) Assignee: Yo Fu Umbrella Co., Ltd., Taipei (TW)

( * ) Notice: Subject to any disclaimer, the term of this patent is extended or adjusted under 35 U.S.C. 154(b) by 260 days.

(21) Appl. No.: 10/714,651

(22) Filed: Nov. 18, 2003

(65) Prior Publication Data

US 2005/0103368 A1 May 19, 2005

(51) Int. Cl.
*A45B 3/00* (2006.01)

(52) U.S. Cl. ..... 135/16; 135/20.1; 248/160; 206/315.4

(58) Field of Classification Search ..... 135/15.1, 135/16–17, 20.1, 25.4, 27–28; 248/160, 248/514; 206/315.4; 224/915; 297/184.16
See application file for complete search history.

(56) References Cited

U.S. PATENT DOCUMENTS 588,958 A * 8/1897 Crandall ..... 135/20.1
3,628,047 A * 12/1971 Cronin et al. ..... 327/544
5,297,570 A * 3/1994 Conner ..... 135/16
5,896,880 A * 4/1999 Bushweller et al. ..... 135/16
5,947,138 A * 9/1999 DeAngelis ..... 135/16
6,471,289 B1 * 10/2002 Aguilar ..... 297/184.16
6,481,147 B1 * 11/2002 Lindaman ..... 43/2
6,810,890 B1 * 11/2004 Lin et al. ..... 135/16
6,899,388 B1 * 5/2005 Enrique ..... 297/184.16

FOREIGN PATENT DOCUMENTS

JP 2002-330808 * 11/2002

* cited by examiner

*Primary Examiner*—Winnie Yip
(74) *Attorney, Agent, or Firm*—Rosenberg, Klein & Lee

(57) ABSTRACT

A golf-sunshade, the main structure of the golf-sunshade comprises a middle-stick, an upper nest member, an under nest member, a fixture and a rib; wherein the top end of the middle-stick connects to the fixture, a flex member is disposed on the fixture, the upper nest member is fixed on the end of a soft pipe, the under nest member is disposed around the outer surface of the middle-stick and is able to slide up/down along the middle-stick and the soft pipe. A main rib and a branch rib of the forefront sector of the rib respectively connects to the upper nest member and the under nest member for effecting opening/closing of the sunshade; the user put the surface of the sunshade at any angle through the flex member disposed on the end of the middle-stick, and the user can take out a golf club etc. from the bag under the sunshade without closing the sunshade. The flex member disposed on the end of the middle-stick makes the user much more conveniently use the sunshade and efficiently reduces the production cost and the size and weight of the sunshade are small and light for easily carrying.

4 Claims, 2 Drawing Sheets

GOLF SUNSHADE

BACKGROUND OF THE INVENTION

1. Field of the Invention

The invention relates to a golf sunshade, and more particularly to a golf sunshade for being conveniently used and efficiently and substantially reducing the production cost thereof.

2. Description of the Prior Art

As golf is developed vigorously in daily life, the requirement of the sport product corresponding to golf is also increased by everyday. Because golf is held in the daytime, the protection against sunburn becomes more important. The main manner that is currently used to protect the skin against sunburn is to use sunshade. Please refer to FIG. 1, it is a schematic diagram that shows the three-dimensional structure of golf sunshade of the prior art. The middle part of middle-stick 10 is connected to a compression spring 11 which is able to be bent. The up and down parts of the middle-stick 10 are connected together via the disposition of the compression spring 11; when using the sunshade, the user can put it on a slant by the disposition of the compression spring 11 for taking out the golf club from the bag under the sunshade; however, the structure of the above-described golf sunshade of the prior art is complicated, and a fixture 12 for fixing is disposed on the joints of the up and down parts of the middle-stick 10 which connect to the compression spring 11. Accordingly, the fixture 12 makes the sunshade hard to be fabricated, and further generates a higher production cost. In the mean time, the sunshade is heavy and the compression spring 11 might clip the hand of the user so as to generate a security problem. The inventor has notice the various disadvantages associated with the conventional golf sunshade and thought to improve it, and after having carried out an intensive study for many years, has successfully developed a golf sunshade of the invention.

SUMMARY OF THE INVENTION

The object of the present invention provides a golf-sunshade for substantially deducing the production cost.

The second object of the present invention provides a golf-sunshade that is easily fabricated and has simple manufacturing process.

The another object of the present invention provides a golf-sunshade which has a simple structure and is easily used for a user.

The another object of the present invention provides a golf-sunshade for substantially increasing the safety when using the sunshade.

The sunshade for achieving the objects of the present invention as described above comprises a middle-stick, an upper nest member, an under nest member, a fixture and a rib; wherein the top end of the middle-stick connects to the fixture, a flex member is disposed on the fixture, the upper nest member is fixed on the end of a soft pipe, the under nest member is disposed around the outer surface of the middle-stick and is able to slide up/down along the middle-stick and the soft pipe. A main rib and a branch rib of the forefront sector of the rib respectively connects to the upper nest member and the under nest member for effecting opening/closing of the sunshade; the user put the surface of the sunshade at any angle through the flex member disposed on the end of the middle-stick, and the user can take out a golf club etc. from the bag under the sunshade without closing the sunshade. The flex member disposed on the end of the middle-stick makes the user much more conveniently use the sunshade and efficiently reduces the production cost and the size and weight of the sunshade are small and light for easily carrying. Also, the present provides safety to the user and prevents clipping the hand of the user.

BRIEF DESCRIPTION OF THE DRAWINGS

The drawings disclose an illustrative embodiment of the present invention which serves to exemplify the various advantages and objects hereof, and as follows.

DETAILED DESCRIPTION OF THE PREFERRED EMBODIMENT

Figure 1:
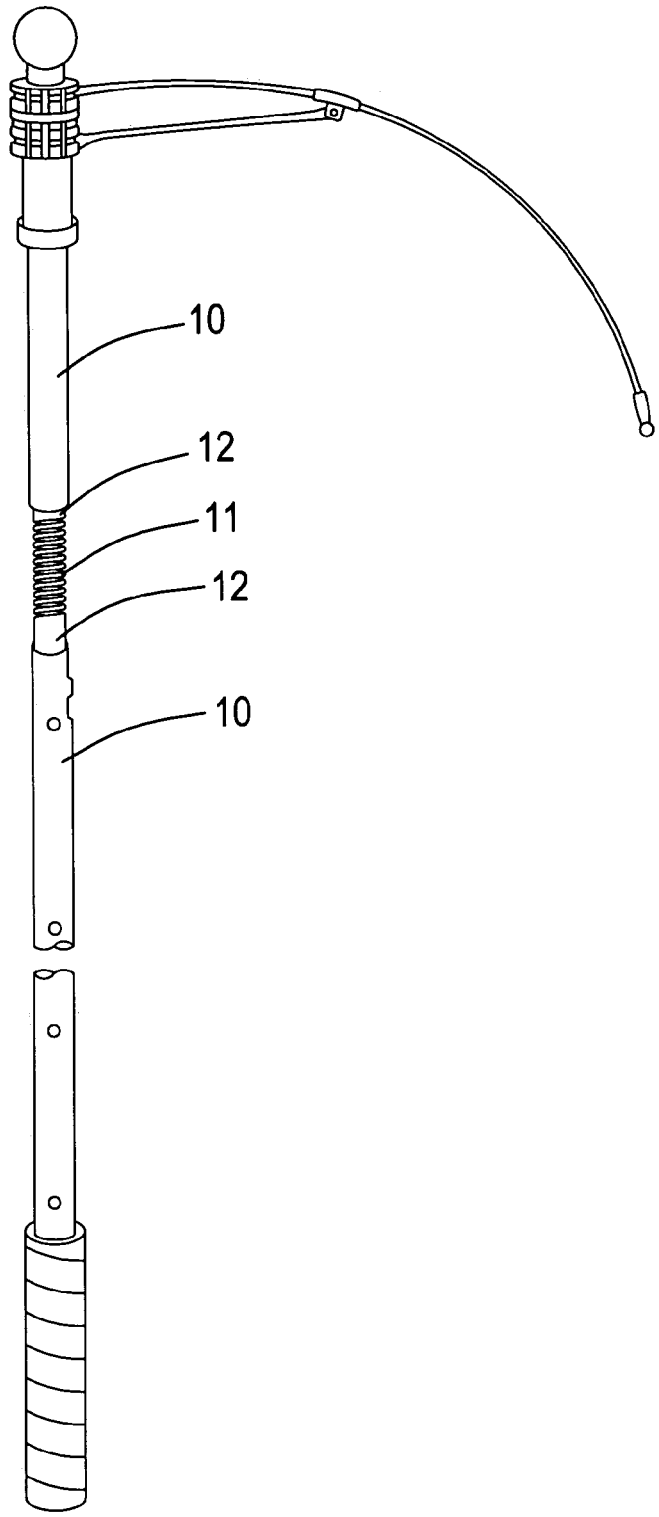
PRIOR ART FIG. 1
FIG. 1 is a three-dimensional structure diagram that shows a golf-sunshade of prior art.
Figure 2:
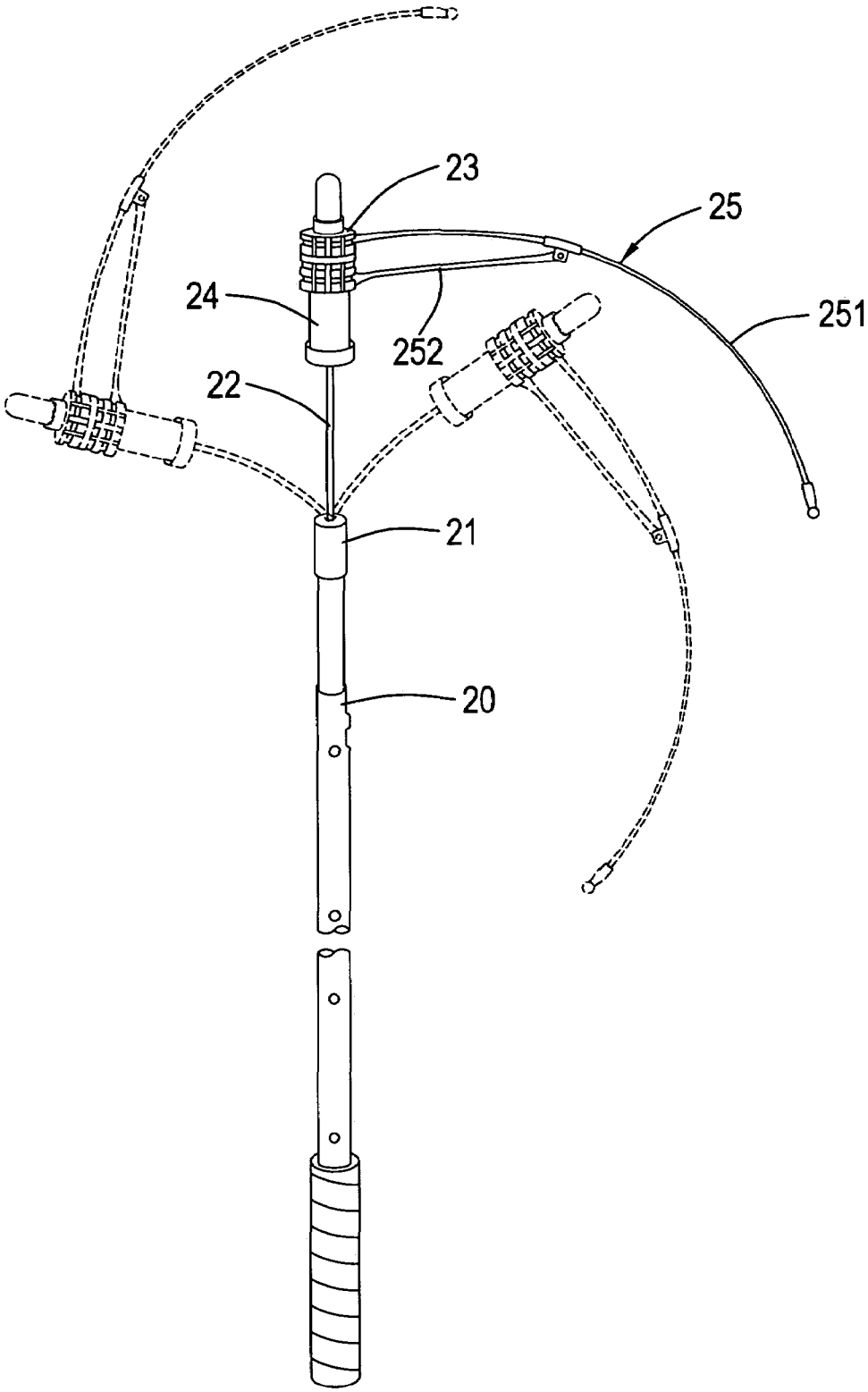
FIG. 2 is a three-dimensional structure diagram that shows a golf-sunshade of the present invention.

Please referring to FIG. 2, it shows a three-dimensional structure diagram of a golf-sunshade according to the present invention, the golf-sunshade comprises:

a middle-stick 20, the middle-stick 20 is a hollow stick;

a fixture 21, the fixture 21 is fixed on the top end of the middle-stick 20;

a flex member 22, the flex member 22 is a slender and soft fiber pipe, the flex member 22 is disposed on the top surface of the fixture 21;

an upper nest member 23, the upper nest member 23 is fixed on the top end of the flex member 22;

an under nest member 24, the under nest member 24 is disposed around the outer surface of the flex member 22 and is able to slide up/down along said the flex member and the middle-stick; and a rib 25, the rib 25 includes a main rib 251 and a branch rib 252 respectively connected to the upper nest member 23 and the under nest member 24.

The user put the surface of the sunshade at any angle through the characteristic of material of flex member 22, and the user can take out a golf club etc. from the bag under the sunshade without closing the sunshade. The flex member disposed on the end of the middle-stick makes the user much more conveniently use the sunshade and efficiently reduces the production cost and the size and weight of the sunshade are small and light for easily carrying. Also, the present provides safety to the user and prevents clipping the hand of the user.

The golf-sunshade provided by the present invention has the following advantages when comparing to the other conventional sunshade:

1. The arrangement of the flex member of the present invention makes the user much more conveniently use the sunshade.
2. The arrangement of the flex member of the present invention substantially reduces the fabrication process and efficiently reduce the production cost.
3. The arrangement of the flex member of the present invention ensures the safety of the user when operating the sunshade.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A golf-sunshade comprising:

a middle-stick, said middle-stick being a stick shaped member;

a flex member, said flex member extending from a top end of said middle-stick;

an upper nest member, said upper nest member being fixed to a top end of said flex member;

an under nest member, said under nest member being disposed around an outer surface of said flex member and slidably displaceable on said flex member and said middle-stick; and a rib, said rib including a main rib and a branch rib respectively connected to said upper nest member and said under nest member.

2. The golf-sunshade according to claim 1, wherein said flex member is a fiber soft pipe.

3. The golf-sunshade according to claim 1, wherein said flex member is formed of tough plastic material by unity shaping.

4. The golf-sunshade according to claim 1, wherein said flex member connects to said middle-stick through a fixture.

* * * * *